United States Patent [19]

Smith, Jr. et al.

[11] 4,200,459

[45] Apr. 29, 1980

[54] HEAT RESISTANT LOW EXPANSION ALLOY

[75] Inventors: Darrell F. Smith, Jr., Huntington, W. Va.; David G. Tipton, Wilmington, N.C.; Edward F. Clatworthy, Huntington; Donald E. Wenschhof, Jr., Milton, both of W. Va.

[73] Assignee: Huntington Alloys, Inc., Huntington, W. Va.

[21] Appl. No.: 860,298

[22] Filed: Dec. 14, 1977

[51] Int. Cl.[2] ..... C22C 19/05; C22C 30/00; C22C 38/06; C22C 38/48

[52] U.S. Cl. ..... 75/170; 75/122; 75/134 F; 148/32.5

[58] Field of Search ..... 75/170, 134 F, 122; 148/32, 32.5

[56] References Cited

U.S. PATENT DOCUMENTS

| | | | |
|---|---|---|---|
| 3,157,495 | 11/1964 | Eiselstein et al. | 75/134 |
| 3,705,827 | 12/1972 | Muzyka et al. | 148/142 |
| 3,971,677 | 7/1976 | Mason et al. | 148/31 |
| 4,006,011 | 2/1977 | Muzyka et al. | 75/122 |
| 4,026,699 | 5/1977 | Eiselstein et al. | 75/134 F |
| 4,066,447 | 1/1978 | Smith et al. | 75/134 F |
| 4,078,951 | 3/1978 | Denzine et al. | 148/32.5 |

OTHER PUBLICATIONS

Muzyka et al., "Phys. Met. . . . Controlled-Expansion Superalloys", Jr. of Metals, Jul. 1975 11 .

Eiselstein et al., "New Ni-Fe-Co Alloys . . . ", Met. Design Engineering, 62 (1965) 105.

*Primary Examiner*—L, Dewayne Rutledge
*Assistant Examiner*—Upendra Roy
*Attorney, Agent, or Firm*—E. C. MacQueen

[57] ABSTRACT

Nickel-iron base alloy characterized by controlled thermal expansion coefficient and inflection temperature and by desirable high strength in age-hardened condition has composition specially restricted to overcome detrimental sensitivity to stress-concentrating geometries and aid resistance to long-enduring stress in heated oxidizing atmospheres. The alloy contains, by weight, 34% to 55.3% nickel, up to 25.2% cobalt, 1% to 2% titanium, 1.5% to 5.5% of columbium plus ½ the weight percent of any tantalum, up to 1% chromium, not more than 0.2% aluminum and the balance essentially iron.

18 Claims, No Drawings

HEAT RESISTANT LOW EXPANSION ALLOY

The present invention relates to nickel-iron base alloys and more particularly to age-hardenable low-expansion alloys for heat resistant service.

Heretofore the art has referred to age-hardenable nickel-iron alloys, including nickel-iron-cobalt alloys, characterized by low coefficients of thermal expansion and high inflection temperatures, such as expansion coefficients (COE) of 4, 5, or up to about $5.5\times10^{-6}$/°F., and inflection temperatures (IT) of about 700° F. or 900° F., e.g., in the paper by H. L. Eiselstein and J. K. Bell, "New Ni-Fe-Co Alloys Provide Constant Modulus + High Temperature Strength," Materials in Design Engineering, November, 1965. While desired expansion and good strength characteristics were obtained, difficulties of sensitivity to stress concentrating geometries, e.g., notches, have been encountered in resisting heat effects at elevated temperatures such as 1000° F., 1150° F. or 1200° F., for instance, in the Muzyka et al paper, "Physical Metallurgy and Properties of a New Controlled-Expansion Superalloy" JOM, July, 1975, and, for overcoming such difficulties, specially restricted heat treatment processing and microstructural conditions, particularly avoiding recrystallization, were proposed in this paper and in U.S. Pat. No. 3,705,827. Moreover, special compositional developments are referred to in U.S. Pat. No. 4,006,011 and in U.S. Patent Application Ser. No. 703,528, filed July 8, 1976 now U.S. Pat. No. 4,066,447. Yet, for commercial production of machines, engines, and other apparatus, it is important to have wide latitude of flexibility in processing, e.g., broad scope of temperatures for forging, brazing, and other fabricating, and also obtain desirably low COE and high IT values and, heretofore, insofar as we are aware, all needs for an alloy composition to enable achieving specially required expansion and heat-resistant characteristics were still unfulfilled.

There has now been discovered a specially restricted alloy composition with special utility for providing products having desirable thermal expansion characteristics and capability for resisting stress concentrations in heated structures.

An object of the invention is to provide a low expansion alloy for elevated temperature service in engines, machines and other structures.

Other objects and advantages of the invention are apparent in the following disclosure.

The present invention contemplates an age-hardenable alloy comprising, by weight, 34% to 55.3% nickel, up to 25.2% cobalt, 1% to 2% titanium, metal from the group columbium and tantalum in an amount providing that the total of columbium plus ½ the weight (percent) of tantalum is 1.5% to 5.5% of the alloy, up to 2% manganese and up to 6.2% chromium provided the total of manganese plus chromium does not exceed 6.2%, and balance essentially iron with any presence of aluminum being restricted to low percentages of 0.20% or lower, e.g., 0.17%, desirably 0.1% or less, such as 0.08%, 0.05% or 0.008% aluminum, and characterized in the age-hardened condition by a thermal expansion inflection temperature of at least 650° F., a coefficient of expansion of $5.5\times10^{-6}$/°F. or lower when heated up to the inflection temperature, and a room temperature yield strength (at 0.2% offset) of at least 110 ksi (110,000 pounds per square inch).

Generally, in most embodiments, the iron content is in the range of about 20% to 55% iron.

Presence of a substantial amount of cobalt, e.g., about 10% or more cobalt, particularly when correlated with nickel to provide a nickel-plus-cobalt content of about 51% to 53%, is often desirable for enhancement of characteristics, e.g., inflection temperature.

Incidental elements, e.g., deoxidizers and malleabilizers, scavengers and tolerable impurities may be amounts such as up to about 0.01% calcium, 0.01% magnesium, 0.03% boron, 0.1% zirconium, 0.5% silicon and up to about 1% each of copper, molybdenum and tungsten. Sulfur and phosphorus are undesirable and usually restricted to avoid exceeding about 0.015% individually.

Frequently, for commercial embodiments of the alloy, any tantalum present does not exceed 10% of the columbium content and in such event differences between columbium and tantalum can be deemed insignificant, and the alloy referred to simply as containing 1.5% to 5.5% columbium or columbium-plus-tantalum. Yet, if desired, the alloy can have up to 11% tantalum.

The age-hardened condition can be obtained by aging in temperature ranges such as about 1350° to 1100° F. for aging times such as 8, 16, or more hours; annealing before aging is recommended.

A useful guideline for ensuring the expansion coefficients, inflection temperatures, and yield strengths that are generally characteristic of the age-hardened alloy is to proportion specific compositions (within percentage ranges of the invention) according to the following relationships, respectively.

A—(%Ni)+0.84(%Co)−1.7(%Ti+%Al)+0.42(%Mn+%Cr) at most 51.5.

B—(%Ni)+1.1(%Co)−1.0(%Ti)−1.8(%Nn+%Cr)−0.33(%Cb+½Ta) at least 44.4.

C—(%Cb+½%Ta)(%Ti)−0.33(%Cr) at least 2.7.

In view of relationships A, B and C it is understood that in alloy compositions according thereto the iron content can be up to 51.2% and is at least 21% iron, e.g., with 11% tantalum, or is at least 26.5% iron with 5.5% columbium and practically no tantalum.

Advantageously, for specially good expansion and strength characteristics, the composition is controlled to contain 35% to 39% nickel, 12% to 16% cobalt, 1.2% to 1.8% titanium, metal from the group columbium and tantalum in an amount providing that the total of columbium plus ½ the weight of tantalum is 3.7% to 4.8% of the alloy, up to 1% each of the elements manganese and chromium, up to 0.012% boron, preferably 0.003% to 0.012% boron, and balance essentially iron with aluminum restricted to low percentages such as 0.1% or lower.

For providing alloys characterized in the age-hardened condition by a thermal coefficient of expansion not greater than $4.5\times10^{-6}$/°F., an inflection temperature of at least 780° F. and a room temperature yield strength of at least 130,000 psi, it is advantageous to proportion the composition to have Rel. A be at most 47.5, Rel. B be at least 48.8 and Rel. C at least 4.8.

Although less precise, the melting control to meet relationships A and B, and certain advantageous embodiments, may be simplified, and good results frequently achieved, to a control of nickel plus cobalt content to be 51% to 53% and with %Ti and %Mn+%Cr about 1.5% and about 0.3%, respectively.

For characterization of the alloy, in specific instances where dilatometer or other actual expansion measurements are not available, thermal expansion properties herein are calculated from compositional percentages according to the following relationships for COE(coefficient of thermal expansion in units of $10^{-6}$/°F., i.e., parts per million per degree Fahrenheit) and IT (inflection temperature in °F.), said relationships being the COE and IT equations set forth below:

$$COE = 0.248(\%Ni) + 0.209(\%Co) - 0.427(\%Al + \%Ti) + 0.104(\%Mn + \%Cr) - 7.39.$$

$$IT = 26.9(\%Ni) + 29.6(\%Co) - 57.2(\%Al) - 28.2(\%Ti) - 47.0(\%Mn + \%Cr) - 8.90(\%Cb + \tfrac{1}{2}\%Ta) - 509.$$

The above COE refers to the mean COE across the temperature range from room temperature to the inflection temperature according to the IT equation above, said equations being based on statistical analysis of dilatometer measurements on a large number of alloys within and moderately outside the ranges of the invention.

Success of the invention in providing an alloy for products and other articles, e.g., turbine engine components, that must resist stress-dependent cracking influences when in use at elevated temperatures is confirmed with test results hereinafter. Inasmuch as hot air is the environment of use for many of the articles concerned, capability or failure to resist stress-dependent cracking is understood to be shown by results of tests wherein specimens of alloys are stressed for long periods in air at elevated temperatures, e.g., notch-rupture tests or stress-cracking tests in heated air chambers at temperatures such as 1000° F. to 1200° F. A type of stress-cracking test referred to as the SAGBO (stress accelerated grain boundary oxidation) test, wherein a strip specimen is held stressed in a bowed, or bent beam, configuration maintained by a fixture placed in a furnace and visually inspected is understood to provide a significant indicia of stress-cracking characteristics since, in many instances, separation of metal such as crack formation and growth has been found to occur at grain boundary oxidation sites and it is understood that the outside surface of a bowed beam is a stress-concentration area.

The alloy can be prepared by melting practices known for production of high quality nickel-iron alloys. Induction melting, by air melt practices and by vacuum melt practices, has been found satisfactory. Other melt practices, e.g., electroflux melting or vacuum-arc melting or remelting, can be utilized if desired. The alloy has good malleability for hot working and for cold working. Moreover, with the alloy composition controlled in accordance with the invention, warm-working followed by recrystallization annealing provides satisfactory results, including good notch-rupture strength characteristics. Herein, warm working refers to the special kind of cold working that is conducted at elevated, nearly hot, temperatures that are below and yet within a few hundred degrees of the alloy recrystallization temperature, e.g., 30° F. to 300° F. below the recrystallization temperature of the alloy being worked. Recrystallized products of the alloy are characterized by equiaxed grain structures that are advantageous for obtaining isotropic strength properties and other properties. Among other benefits, the satisfactoriness of the alloy for warm working methods is beneficial to efficiency and economy in commercial production inasmuch as forging, rolling or other working of the alloy can be continued while the alloy cools down from the hot working range and through and below the recrystallization temperature, thus avoiding lost time and expense of interrupting working in order to reheat.

Hot working of ingots of the alloy can commence at around 2100° F. and can continue down to the warm working range and, if desired, working of the hot-worked alloy can continue as the alloy cools into the warm working range. Reheating for crystallization annealing of the warm worked alloy is generally done in the range of about 1700° F. to 1900° F. for about one hour to one-quarter hour, depending, of course, on metal thickness and the amount of work energy retained while working below the recrystallization temperature. Annealing one hour at 1700° F., or ¼-hour at 1900° F., or proportionately therebetween, is desirable for producing fine-grain structures in bar stock, although in thin strip the grain may coarsen sooner. Fine-grain structures are advantageous for ensuring good stress-cracking resistance (including notch-rupture strength) and high room-temperature strength; yet, in some embodiments the alloy has good stress-cracking resistance in both the coarse and the fine grain conditions.

In reference to products of the invention, grain structures referred to as recrystallized fine are characterized by an average grain size of up to about ASTM No. 5, frequently ASTM No. 5 to No. 8, whereas grain structures referred to as recrystallized coarse have an average grain size of about ASTM No. 4.5 or larger, frequently ASTM No. 2 to No. 4.

Recrystallization annealing at temperatures of at least 1700° F. also serves toward placing the alloy in a homogeneous solid-solution condition with most, if not all, the gamma-prime forming elements in solution, as preparation for an aging treatment. (The anneal is not a carbide-solution anneal.) Water quenching after annealing is desirable for retaining the solution condition until the next treatment step, although in some instances a slower cooling, e.g., air cooling, may be satisfactory.

The alloy is strengthened by aging at temperatures of about 1150° F. to 1350° F. for about 8 or more hours. Desirably, the hot-worked alloy, with or without warm or cold working, is placed in a solid-solution condition prior to aging, albeit good results may in some instances be obtainable without a full solution treatment. An especially satisfactory aging treatment comprises, in continuous sequence, holding at 1325° F. for 8 hours, furnace cooling therefrom at a rate of 100° F. per hour to 1150° F., holding at 1150° F. for 8 hours and then cooling in air, or in the furnace, to room temperature. Intermediate treatments at 1350° F. to 1550° F. may be recommendable for benefitting rupture ductility or SAGBO life.

Generally, in both the fine-grain and the coarse-grain conditions, the age-hardened products have at least 110 ksi yield strength and about 10% or more tensile elongation at room temperature.

For purposes of giving those skilled in the art a further understanding of the invention the following examples are given.

EXAMPLE I

A vacuum-induction melt for an iron-base alloy containing about 36% nickel, 17% cobalt, 3% columbium, and 1.5% titanium (alloy 1) was prepared and vacuum-cast into an ingot mold. Small amounts of boron and calcium were added to the melt prior to tapping. Results of chemical analysis of alloy 1 are set forth in Table I hereinafter. Metal of the ingot was hot rolled to ¼-inch thickness and then cold rolled to 0.06-inch sheet. Test blanks ¾-inch and ⅜-inch, ×4-inches were then sheared and heat treated with an anneal-plus-age treatment of 1900° F. for 0.25 hour, water quench, plus 1325° F. for 8 hours, furnace cool at 100° F./Hr. from 1325° F. to 1150° F., hold 8 hours at 1150° F., and air cool, which resulted in recrystallizing the strip to a coarse grain structure about ASTM 4.5, or four to five. Room temperature(RT) and 1000° F. determinations of 0.2% offset yield strength(YS), ultimate tensile strength(UTS), elongation(El) and reduction of area(RA) were made with tensile specimens taken transverse (perpendicular) to the direction of rolling, with results set forth in the following Table II. The results of 127.5 Ksi room-temperature yield strength with 14% elongation demonstrate very good mechanical properties at room temperature.

To evaluate high temperature stress-cracking resistance, transverse specimens for SAGBO testing were prepared by surface grinding the aged ⅜" blanks to 320 grit, accurately measuring the thickness, computing the required length according to ASTM "Recommended Practice for Preparation and Use of Bent-Beam Stress-Corrosion Specimens" G39-72 for the selected test stress with compensation for test fixture expansion, and cutting to required length. The ends of the specimens were ground to chisel edges to provide for point contact on the specimen holder. A thus-prepared specimen of alloy 1 was placed in the test fixture and loaded by tightening the fixture bolts sufficiently to result in 150 Ksi stress during elevated temperature testing at 1000° F. The fixture holding the specimen was maintained at 1000° F. in a box furnace having an observation window and the specimen was examined visually from time to time, e.g., 4 or 24-hour intervals, while constantly under load for 294 hours and then failed by cracking in the following hour, thus having a life of 294 hour with 150 ksi stress at 1000° F.

This 294 hour result is understood to show that the alloy 1 composition provides for very good stress-cracking resistance inasmuch as the specimen was taken from sheet that had been cold-rolled transversely to the specimen length.

And, even though the 1900° F./0.25 hour anneal is beneficial to isotropy, the testing of specimens taken transverse to rolling is considered to be a more severe criterion than testing specimens taken parallel to rolling.

Results of chemical analysis of additional examples of the invention are set forth along with those of alloy 1 in the following Table I. Also shown in Table I are results of chemically analyzing other alloys that differ from the present invention and which are referred herein to as alloys A through G.

Table IA shows values of Relationships A, B and C, and of COE and IT characteristics computed according to equations herein.

Further, Table II shows results of evaluating mechanical properties of examples of the invention and of different alloys. Under the SAGBO heading in Table II, TL (Time of Life) refers to the longest time when the specimen was examined before fracture occurred; and TC (Time Cracked) refers to the earliest time the specimen was found to be fractured. Thus, the SAGBO life is a time intermediate between TL and TC.

TABLE I

| | Chemical Analyses (weight percent) Balance Iron | | | | | | | | | |
|---|---|---|---|---|---|---|---|---|---|---|
| Alloy No. | Ni (%) | Co (%) | Al (%) | Cr (%) | Cb + Ta (%) | Ti (%) | C (%) | B (%) | Ca (%) | Mn (%) |
| 1 | 36.08 | 17.31 | 0.094 | 0.019 | 3.12 | 1.45 | 0.03 | 0.007 | 0.015 | 0.14 |
| 2 | 35.83 | 17.06 | 0.055 | 0.31 | 4.15 | 1.38 | 0.02 | 0.006 | 0.029 | 0.16 |
| 3 | 34.76 | 17.63 | 0.13 | 1.72 | 4.26 | 1.46 | 0.02 | 0.007 | 0.023 | 0.13 |
| 4 | 37.48 | 14.50 | 0.083 | 0.006 | 3.91 | 1.30 | 0.02 | 0.007 | 0.003 | 0.14 |
| 5 | 37.92 | 14.65 | 0.08 | NA | 3.26 | 1.23 | 0.03 | 0.0035 | 0.001 | 0.12 |
| 6 | 37.64 | 14.68 | 0.17 | NA | 3.20 | 1.52 | 0.02 | 0.0035 | 0.002 | 0.16 |
| 7 | 38.88 | 15.18 | 0.18 | NA | 2.97 | 1.21 | 0.006 | 0.023 | 0.002 | 0.06 |
| 8 | 35.59 | 15.59 | 0.20 | 3.78 | 3.00 | 1.36 | 0.03 | 0.004 | 0.007 | 0.13 |
| 9 | 37.66 | 14.35 | 0.05 | 0.55 | 4.14 | 1.35 | 0.005 | 0.006 | <0.001 | 0.13 |
| 10 | 36.82 | 14.59 | 0.07 | 0.26 | 4.25 | 1.39 | 0.006 | 0.007 | 0.031 | 0.14 |
| 11 | 37.25 | 14.53 | 0.10 | 0.66 | 4.36 | 1.35 | 0.02 | 0.007 | 0.023 | 0.13 |
| 12 | 37.36 | 14.61 | 0.014 | 0.005 | 4.10 | 1.47 | 0.01 | 0.008 | 0.008 | <0.01 |
| 13 | 37.56 | 14.39 | 0.008 | 0.007 | 3.89 | 1.46 | 0.01 | <0.001 | 0.006 | <0.01 |
| A | 37.55 | 14.79 | 0.25 | 0.19 | 2.87 | 1.37 | 0.02 | 0.003 | 0.006 | 0.16 |
| B | 38.38 | 15.30 | 0.84 | 0.37 | 3.12 | 1.39 | 0.02 | 0.005 | 0.006 | 0.13 |
| C | 37.62 | 14.64 | 0.34 | NA | 3.13 | 1.57 | 0.02 | 0.0036 | 0.002 | 0.17 |
| D | 37.54 | 14.50 | 0.67 | NA | 3.28 | 1.59 | 0.005 | 0.0033 | 0.002 | 0.15 |
| E | 38.53 | 15.17 | 0.30 | 0.032 | 3.38 | 1.26 | 0.006 | 0.022 | 0.002 | 0.05 |
| F | 38.45 | 15.25 | 0.69 | 0.015 | 3.35 | 1.56 | 0.008 | 0.025 | 0.005 | 0.06 |
| G | 38.53 | 14.84 | 0.66 | 0.019 | 2.97 | 1.33 | 0.02 | 0.010 | 0.002 | 0.20 |

Cb + Ta analysis may include tantalum in amounts up to 2% of reported Cb + Ta; actual analysis showed 0.02% Ta in Alloy 1 and 0.03% Ta in Alloy 3 and less than 0.01% Ta in Alloys 8, A and B.
NA = not added and not analyzed.
Instances of analyses for incidentals showed less than 0.2% Si, 0.15% Cu, 0.05% Mo, 0.015% S and 0.010% P.

TABLE IA

| Alloy | A | B | C | COE ($X10^{-6}$/°F.) | IT (°F.) |
|---|---|---|---|---|---|
| 1 | 48.1 | 52.4 | 4.5 | 4.54 | 892 |
| 2 | 47.8 | 51.3 | 5.7 | 4.48 | 858 |
| 3 | 47.6 | 48.0 | 5.6 | 4.43 | 774 |
| 4 | 48.1 | 47.5 | 4.5 | 4.54 | 845 |
| 5 | 48.0 | 51.5 | 4.0 | 4.53 (4.66) | 870 (882) |
| 6 | 47.2 | 50.9 | 4.9 | 4.31 (4.32) | 849 (860) |
| 7 | 49.3 | 53.3 | 3.6 | 4.84 | 912 |
| 8 | 47.7 | 43.4 | 2.8 | 4.44 | 649 |
| 9 | 47.6 | 49.5 | 5.4 | 4.43 | 819 |
| 10 | 46.9 | 49.4 | 5.7 | 4.24 | 813 |
| 11 | 47.3 | 49.0 | 5.7 | 4.35 | 803 |
| 12 | 47.1 | 50.6 | 6.0 | 4.30 | 849 |
| 13 | 47.2 | 50.6 | 5.7 | 4.31 | 850 |
| A | 47.4 | 50.9 | 3.9 | 4.36 | 844 |
| B | 47.7 | 51.9 | 4.2 | 4.43 | 837 |
| C | 46.7 | 50.8 | 4.9 | 4.21 (4.21) | 836 (838) |

TABLE IA-continued

| Alloy | A | B | C | COE ($X10^{-6}$/°F.) | IT (°F.) |
|---|---|---|---|---|---|
| D | 45.9 | 50.6 | 5.2 | 4.00 (3.99) | 810 (815) |
| E | 48.7 | 52.7 | 4.2 | 4.68 | 889 |
| F | 47.5 | 52.4 | 5.2 | 4.38 | 860 |
| G | 47.7 | 52.2 | 3.9 | 4.44 (4.48) | 854 (860) |

(Dilatometer determinations)

TABLE II

Transverse Specimens from Cold Rolled Strip (0.060" thick × 4" width)
Heat Treated 1900° F./0.25 hr., W.Q. + 1325° F./8 hr., FC 100°/hr to 1150° F./8 hrs. AC

| | Room Temp. Tensile | | | 1000° F. Tensile | | | 1000° F. SAGBO Specimen Life | | | 1000° F. Stress-Rupture 120.0 Ksi | |
|---|---|---|---|---|---|---|---|---|---|---|---|
| Alloy No. | YS Ksi | UTS Ksi | El % | YS Ksi | UTS Ksi | El % | Stress Ksi | TL Hr. | TC Hr. | Life Hr. | El % |
| 1 | 127.5 | 163.0 | 14.0 | 102.0 | 129.5 | 11.0 | 150.0 | 294.0 | 294.0 | 7.6 | 2.5 |
| 2 | 142.5 | 176.5 | 14.0 | 115.5 | 138.5 | 13.0 | 150.0 | 220.0 | 234.0 | 15.2 | 1.0 |
| 3 | 142.0 | 183.5 | 16.0 | 110.0 | 145.0 | 17.0 | 150.0 | 195.8 | 214.8 | 28.7 | 2.0 |
| 4(1) | 131.0 | 165.5 | 15.0 | 102.5 | 137.5 | 13.0 | 148.8 | 209.2 | 247.7 | 21.7 | 3.0 |
| 8 | 128.5 | 173.0 | 10.0 | 115.0 | 140.5 | 16.5 | 150.0 | 114.3 | 115.3 | 24.0 | 1.5 |
| 9(1) | 139.5 | 173.5 | 14.0 | 109.5 | 139.5 | 13.0 | 150.6 | 523.2 | 531.5 | 50.9 | 2.0 |
| 10(1) | 146.5 | 177.0 | 12.0 | 124.0 | 140.0 | 15.0 | 150.0 | 663.0 | 687.0 | 24.6 | 1.0 |
| 11(1) | 140.0 | 176.0 | 16.0 | 108.5 | 139.5 | 16.0 | 148.7 | 216.8 | 283.0 | 49.6 | 2.0 |
| 12 | 139.5 | 174.5 | 16.0 | 124.5 | 151.0 | 16.0 | 153.9 | 1253 + | NC,TD | 71.5 | BOGM |
| 13 | 130.5 | 173.5 | 17.0 | 108.5 | 141.0 | 15.0 | 160.0 | 1253 + | NC,TD | 23.1 | 1.6 |
| A | 125.5 | 153.0 | 11.0 | 111.5 | 137.5 | 14.0 | 148.7 | 82.0 | 89.0 | 2.5 | 2.5 |
| B | 134.5 | 164.0 | 12.0 | 113.5 | 138.5 | 15.0 | 150.5 | 7.5 | 17.2 | 1.0 | 1.0 |

NC,TD - Not Cracked, Test Discontinued
BOGM - Break Outside Gage Marks
TL = Time of Longest observed life
TC = Time found cracked
Tensile & Stress-Rupture Specimens - Gage Dimensions - 0.200" width × 1.250" length, Except Alloys Having (1) Where Gage Dimensions were 0.250" width × 1.250" length Specimens for evaluating 1200° F. notch-rupture characteristics, and room temperature and 1200° F. short-time tensile characteristics, were taken from 9/16-inch square bar forgings of alloys 5, 6 and 7 and alloys C to F with results set forth in Table III. These alloys were vacuum-induction melted, cast to ingots and then forged. Forging practice was to hammer-forge the ingot in ¼" steps, at 2050° F. with reheating to 2050° F. as needed, to 11/16" square bar, cool on the hammer to about 1600° F. and then finish forge to 9/16" square bar, and air-cool. Grain sizes in the specimens, after heat treatment as set forth in the table, were about ASTM 7 to 9.

Results in Table III illustrate benefits of restriction of aluminum to avoid exceeding 0.2%, in order to obtain desirably good combinations of strength, ductility and resistance to fracture at stress-concentrating sections, e.g., notches.

And, taking results in Table II and Table III in conjunction with analyses in Table I, it is evident that long-time resistance to fracture is benefited when aluminum is restricted. Among other things, it can be noted alloy 2 is illustrative of obtaining substantial life when a small amount of aluminum is present along with a small amount of chromium, and it is contemplated that including aluminum in small amounts such as about 0.05% is recommendable for ensuring long life when small amounts of chromium, such as about 0.3% or 0.5% chromium, are present, since anomalous instances of short life have occurred with one alloy which analyses showed to contain 0.58% chromium and 0.006% aluminum.

TABLE III

| Alloy No. | H.T. | Room Temp. Tensile YS Ksi | UTS Ksi | El % | RA % | 1200° F. Tensile YS Ksi | UTS Ksi | El % | RA % | 1200° F. Stress-Rupture (Notch/Smooth Specimen) *Stress Ksi | Life Hr. | El % | RA % | |
|---|---|---|---|---|---|---|---|---|---|---|---|---|---|---|
| 5 | A | 116.0 | 161.5 | 21 | 53 | 106.5 | 122.5 | 24 | 57 | 75 | 69.5 | 31 | 48 | |
| " | B | | | | | | | | | 80 | 64.4 | 14 | 45 | |
| 6 | A | 144.0 | 188.0 | 19 | 40 | 120.0 | 135.0 | 23 | 57 | 85 | 96.4 | 17 | 25 | |
| | B | | | | | | | | | 95 | 99.2 | 14 | 32 | |
| | B | | | | | | | | | 100 | 107.9 | 12 | 21 | Retest |
| 7 | A | 138.0 | 168.5 | 18 | 47 | 111.5 | 122.5 | 27 | 60 | 90 | 92.7 | 22 | 54 | |
| | B | | | | | | | | | 95 | 104.0 | 19 | 31 | |
| C | A | 154.5 | 190.0 | 19 | 48 | 125 | 141.5 | 22 | 46 | 70 | 4.2 | NOTCH | | |
| | A | | | | | | | | | 105 | 143.7 | 14 | 24 | Retest |
| | B | | | | | | | | | 70 | 14.9 | NOTCH | | |
| | B | | | | | | | | | 105 | 129.0 | 10 | 10 | Retest |
| D | A | 165.0 | 199.0 | 16 | 33 | 132.5 | 147.5 | 12 | 18 | 70 | 2.4 | NOTCH | | |
| | A | | | | | | | | | 70 | 11.6 | NOTCH | | Retest |
| | B | | | | | | | | | 70 | 4.8 | NOTCH | | |
| E | A | 149.0 | 186.0 | 19 | 39 | 127.5 | 138.0 | 20 | 56 | 100 | 114.5 | 25 | 54 | |
| | B | | | | | | | | | 100 | 118.2 | 11 | 15 | |
| F | A | 171.0 | 202.5 | 14 | 41 | 134.0 | 151.0 | 21 | 50 | 115 | 154.5 | 21 | 35 | |

TABLE III-continued

| Alloy No. | H.T. | Room Temp. Tensile YS Ksi | UTS Ksi | El % | RA % | 1200° F. Tensile YS Ksi | UTS Ksi | El % | RA % | 1200° F. Stress-Rupture (Notch/Smooth Specimen) *Stress Ksi | Life Hr. | El % | RA % |
|---|---|---|---|---|---|---|---|---|---|---|---|---|---|
| | B | | | | | | | | | 70 | 3.2 | NOTCH | |

Specimens from 9/16" square bar forgings
Heat Treated A - 1625° F./1 hr. WQ, 1325° F./8 hr + FC 100° F./hr + 1150° F./8 hr. AC
B - 1700° F./1 hr. WQ, 1325° F./8 hr + FC 100° F./hr + 1150° F./8 hr. AC
*Stress at rupture. Initially stressed at 70 ksi for about 48 hours, then increased 5 ksi at intervals of about 8-16 hours.
Tensile Specimens .252" dia. 1.250" length gage (RTT)
.252" dia. 1.000" length gage (HTT)
Notch/Smooth Specimens .178" dia., .715" length smooth; Notch $K_t$ = 3.6

Weldability evaluations by the Varestraint test method indicated the alloy of the invention to have improved resistance to weld-cracking in comparison with a commercial version of the Eiselstein and Bell low-expansion nickel-cobalt-iron alloy, which is exemplified herein as alloy G. Alloy G, with analysis in Table I, was processed by commercial production practices for vacuum-induction melted heats of the Eiselstein and Bell alloy. Results of Varestraint tests on specimens of alloys 12, 13, and G in the hot-rolled condition are set forth in the following Table IV.

Electron beam weldability evaulations of alloys 12 and 13 in the as-rolled and in the 1900° F./0.25 hr anneal-plus-aged conditions indicated weldability to be about as good as is typical of the commercial alloy, with little difference between the as-rolled and the heat-treated conditions (both about ASTM Grain Size #5). Among the small number of electron beam tests, alloy 12 appeared best resistant to underbead cracking and, actually, No Indications of cracking were found in metallographic examinations of bend test results with alloy 12 in the as-rolled and the heat-treated conditions.

TABLE IV

| Alloy | Varestraint Test Results: 50 Inch Radius Block Test Thick(in) | MCL (mils) | Ave MCL | TCL (mils) | Ave TCL | 25 Inch Radius Block Test Thick(in) | MCL (mils) | Ave MCL | TCL (mils) | Ave TCL |
|---|---|---|---|---|---|---|---|---|---|---|
| 12 | .291 | 0 | | 0 | | .290 | 55 | | 103 | |
| | .291 | 0 | 0 | 0 | 0 | .291 | 40 | 44 | 109 | 83 |
| | .290 | 0 | | 0 | | .290 | 38 | | 38 | |
| 13 | .289 | 0 | | 0 | | .293 | 80 | | 140 | |
| | .290 | 0 | 0 | 0 | 0 | .291 | 82 | 67 | 145 | 146 |
| | .289 | 0 | | 0 | | .291 | 40 | | 163 | |
| G | .305 | 25 | | 25 | | .302 | 90 | | 146 | |
| | .309 | 0 | 17 | 0 | 17 | .305 | 70 | 77 | 199 | 167 |
| | .301 | 25 | | 25 | | .305 | 70 | | 155 | |

MCL = Maximum length of longest crack
Ave = Average
TCL = Total length of all cracks found
Amperage = 190
Voltage = 13.1
Travel Speed 5-in/min.

The alloy has good fabricability characteristics for rolling and forging in hot, warm and cold conditions and has good machinability. The alloy has good brazeability for joining articles, including wrought products such as sheet and strip, of the alloy to other articles of the same or different alloys. Some of the specially desirable features of the alloy include capability for providing good strength and ductility characteristics in cold (or warm) worked sections that are subsequently heated for brazing, or other needs, to high elevated temperatures, e.g., 1900° F.

The present invention is applicable in production of articles for turbine engines and other and structures for sustaining stresses during heating and cooling between temperatures such as room temperature and about 600° F., 1000° F. or 1200° F., e.g., seals, brackets, flanges, shafts, bolts and casings used in gas turbines.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An age-hardenable alloy comprising 34% to 55.3% nickel, up to 25.2% cobalt, 1% to 2% titanium, 1.5% to 11% metal from the group columbium, tantalum and mixtures thereof in an amount providing that the total of columbium plus ½ tantalum is 1.5% to 5.5% of the alloy, up to 2% manganese and up to 1% chromium, and balance essentially iron with any presence of aluminum being restricted to 0.20% or lower, and characterized in the age-hardened conditioned by a thermal expansion inflection temperature of at least 650° F., a coefficient of expansion of $5.5\% \times 10^{-6}$ per °F. and a room temperature yield strength of at least 110,000 pounds per square inch.

2. An alloy as set forth in claim 1 wherein any aluminum content does not exceed 0.10%.

3. An alloy as set forth in claim 1 wherein any aluminum content does not exceed 0.05%.

4. An alloy as set forth in claim 1 containing 35% to 39% nickel, 12% to 16% cobalt, 1.2% to 1.8% titanium, 3.7% to 4.8% columbium plus ½ tantalum, up to 1% manganese, up to 1% chromium, up to 0.10% aluminum and characterized in the age-hardened condition by an inflection temperature of at least 780° F., an expansion coefficient not greater than $4.5 \times 10^{-6}$/°F. and a room temperature yield strength of at least 130,000 psi.

5. An alloy consisting essentially of 34% to 55.3% nickel, up to 25.2% cobalt, 1% to 2% titanium, 1.5% to 11% metal from the group columbium, tantalum and mixtures thereof in an amount providing that the total of columbium plus ½ tantalum is 1.5% to 5.5% of the alloy, up to 2% manganese and up to 1% chromium, up to 0.03% boron and balance essentially iron with any presence of aluminum being restricted to 0.20% or lower and wherein the composition is proportioned according to the following relationships A, B and C A—(%Ni)+0.84(%Co)−1.7(%Ti−%Al)+0.42(%Mn+Cr) at most 51.5

B—(%Ni)+1.1(%Co)−1.0(%Ti)−1.8(%Mn+%Cr)−0.33(%Cb+½Ta) at least 44.4

C—(%Cb+½%Ta)(%Ti)−0.33(%Cr) at least 2.7.

6. An alloy as set forth in claim 5 containing less than 0.10% aluminum.

7. An alloy as set forth in claim 5 containing less than 0.05% aluminum.

8. An alloy as set forth in claim 5 proportioned to provide that Rel. A is not greater than 47.5, Rel. B is at least 48.8 and Rel. C is at least 4.8.

9. An alloy as set forth in claim 5 wherein the total of nickel plus cobalt is 51% to 53%.

10. An alloy set forth in claim 5 wherein the total of nickel plus cobalt is 51% to 53%, the titanium content is about 1.5%, and the total of manganese plus chromium is about 0.3%.

11. An alloy as set forth in claim 5 containing at least 10% cobalt.

12. An alloy as set forth in claim 5 containing at least 1.5% columbium and wherein any tantalum present does not exceed 10% of the columbium content.

13. An alloy as set forth in claim 5 containing 3.7% to 4.8% columbium and wherein any tantalum present does not exceed 10% of the columbium content.

14. An alloy as set forth in claim 5 containing 0.003% to 0.012% boron.

15. An alloy as set forth in claim 5 containing 35% to 39% nickel, 12% to 16% cobalt, 1.2% to 1.8% titanium, 3.7% to 4.8% columbium plus ½ tantalum, up to 1% manganese, up to 1% chromium, up to 0.012% boron, and balance essentially iron with any aluminum restricted to 0.1% or lower.

16. An alloy as set forth in claim 15 containing at least 0.003% boron.

17. A wrought-and-age hardened alloy product characterized by the alloy composition set forth in claim 5, an inflection temperature of at least 650° F., an expansion coefficient of $5.5\times10^{-6}$/°F. or lower and a room temperature yield strength of at least 110,000 psi.

18. A product as set forth in claim 17 having a recrystallized grain structure of ASTM size No. 2 or finer.

* * * * *

UNITED STATES PATENT AND TRADEMARK OFFICE

CERTIFICATE OF CORRECTION

PATENT NO. : B1 4.200.459

DATED : August 23, 1983

INVENTOR(S) : Darrell F. Smith, Jr. et al

It is certified that error appears in the above-identified patent and that said Letters Patent is hereby corrected as shown below:

Column 2, line 35, "%Nn" should read --%Mn--.

Column 11, line 11, claim 5, the minus "(-)" sign appearing after Ti should be a plus --(+)-- sign.

Signed and Sealed this

Seventh Day of October, 1986

[SEAL]

*Attest:*

DONALD J. QUIGG

*Attesting Officer*

*Commissioner of Patents and Trademarks*

REEXAMINATION CERTIFICATE (119th)

United States Patent [19]

Smith, Jr. et al.

[11] B1 4,200,459

[45] Certificate Issued Aug. 23, 1983

[54] HEAT RESISTANT LOW EXPANSION ALLOY

[75] Inventors: Darrell F. Smith, Jr., Huntington, W. Va.; David G. Tipton, Wilmington, N.C.; Edward F. Clatworthy, Huntington; Donald E. Wenschhof, Jr., Milton, both of W. Va.

[73] Assignee: Huntington Alloys, Inc., Huntington, W. Va.

Reexamination Request:
No. 90/000,184, Mar. 29, 1982

Reexamination Certificate for:

| | |
|---|---|
| Patent No.: | **4,200,459** |
| Issued: | **Apr. 29, 1980** |
| Appl. No.: | **860,298** |
| Filed: | **Dec. 14, 1977** |

[51] Int. Cl.[3] ..... C22C 19/05; C22C 30/00; C22C 38/06; C22C 38/48

[52] U.S. Cl. ..... 75/170; 75/122; 75/123 S; 75/123 K; 75/123 L; 75/134 F; 148/32.5

[58] Field of Search ..... 75/170, 122, 123 S, 75/123, K, 123 L, 134 F; 148/32.5

[56] References Cited

U.S. PATENT DOCUMENTS 4,190,437 2/1980 Boesch et al. ..... 75/122

FOREIGN PATENT DOCUMENTS 1411693 5/1974 United Kingdom .

*Primary Examiner*—Upendra Roy

[57] ABSTRACT

Nickel-iron base alloy characterized by controlled thermal expansion coefficient and inflection temperature and by desirable high strength in age-hardened condition has composition specially restricted to overcome detrimental sensitivity to stress-concentrating geometries and aid resistance to long-enduring stress in heated oxidizing atmospheres. The alloy contains, by weight, 34% to 55.3% nickel, up to 25.2% cobalt, 1% to 2% titanium, 1.5% to 5.5% of columbium plus ½ the weight percent of any tantalum, up to 1% chromium, not more than 0.2% aluminum and the balance essentially iron.

REEXAMINATION CERTIFICATE ISSUED UNDER 35 U.S.C. 307.

HEAT RESISTANT LOW EXPANSION ALLOY

THE PATENT IS HEREBY AMENDED AS INDICATED BELOW.

AS A RESULT OF REEXAMINATION, IT HAS BEEN DETERMINED THAT:

The patentability of claims 5–18 is confirmed.

Claims 1–4 having been finally determined to be unpatentable, are cancelled.

* * * * *